US006381985B1

(12) United States Patent
Burgard

(10) Patent No.: US 6,381,985 B1
(45) Date of Patent: May 7, 2002

(54) INTERCHANGEABLE ORNAMENT DISPLAY JEWELRY APPARATUS

(76) Inventor: Gregg Burgard, 4721 Brenda St. NE., Albuquerque, NM (US) 87109

( * ) Notice: Subject to any disclaimer, the term of this patent is extended or adjusted under 35 U.S.C. 154(b) by 0 days.

(21) Appl. No.: 09/615,668

(22) Filed: Jul. 14, 2000

Related U.S. Application Data

(60) Provisional application No. 60/143,900, filed on Jul. 14, 1999.

(51) Int. Cl.[7] ..... A44C 17/02

(52) U.S. Cl. ..... 63/29.1; 29/3.1; 29/20; 29/40

(58) Field of Search ..... 63/29.1, 3.1, 4, 63/22, 23, 40, 1.16, 20, 13

(56) References Cited

U.S. PATENT DOCUMENTS

| | | | | | |
|---|---|---|---|---|---|
| 763,097 | A | * | 6/1904 | Epple | |
| 996,678 | A | * | 7/1911 | Reynolds | |
| 1,141,992 | A | * | 6/1915 | Toelcke | |
| 1,521,619 | A | * | 1/1925 | Haas | |
| 1,710,734 | A | | 4/1929 | Johnson | |
| 1,792,534 | A | | 2/1931 | Germain | |
| 2,357,782 | A | * | 9/1944 | Rubin | |
| 2,402,956 | A | * | 7/1946 | Fyfe | |
| 3,529,373 | A | * | 9/1970 | Aaskov | |
| 3,983,716 | A | * | 10/1976 | Kuhn | 63/1 |
| 4,259,850 | A | | 4/1981 | Lalieu | |
| 4,265,098 | A | * | 5/1981 | Wayne | 63/2 |
| 4,276,757 | A | * | 7/1981 | Boening | 63/1 |
| 4,353,225 | A | | 10/1982 | Rogers | |
| 4,430,869 | A | | 2/1984 | Zinni | |
| 4,726,200 | A | | 2/1988 | Carter | |
| 4,783,974 | A | * | 11/1988 | Hernandez | 63/2 |
| 4,879,882 | A | | 11/1989 | Johnson et al. | |
| 5,048,311 | A | * | 9/1991 | Mastrobuono | 63/12 |
| 5,052,195 | A | * | 10/1991 | Lunt | 63/21 |
| 5,836,176 | A | | 11/1998 | Lichtenstein et al. | |

OTHER PUBLICATIONS

Change–A–Bead, advertisement, Beth Williams (1998) *Lapidary Journal*, Oct. 1998 issue.

* cited by examiner

*Primary Examiner*—Anthony Knight
*Assistant Examiner*—Alison K. Pickard
(74) *Attorney, Agent, or Firm*—Rod D. Baker; Deborah A. Peacock; Jeffrey D. Myers

(57) ABSTRACT

A jewelry apparatus. The jewelry apparatus may be adapted to serve as practically any type of jewelry, but is best suited for use as a pendant or a broach. A shaft portion may be removably attached to a base piece by means of a slotted locking member. The shaft piece is used to carry ornamental elements, such as decorative beads or precious or semi-precious stones. The ornamental elements may be permanently affixed to the shaft, or most desirably may be slipped onto the shaft so as to be interchangeable. Accordingly, the invention permits a user to change the ornamental elements by removing the shaft from the base piece and selectively interchanging the ornamental elements and then replacing the shaft upon the base piece. Alternatively, the entire shaft with ornamental elements thereon may be selectively replaced. In either case, a single base piece is used, allowing the user to change the overall appearance of the jewelry apparatus to customize it to occasion or apparel, two security features are provided to assure that the shaft cannot accidentally be removed from the base piece to result in the loss of the ornamental elements.

20 Claims, 3 Drawing Sheets

INTERCHANGEABLE ORNAMENT DISPLAY JEWELRY APPARATUS

CROSS-REFERENCE TO RELATED APPLICATIONS

This application claims the benefit of the filing of U.S. Provisional Patent Application Ser. No. 60/143,900, entitled "Interchangeable Ornament Jewelry Display", filed on July 14, 1999, and the specification thereof is incorporated herein by reference. This application is related to co-pending utility application Ser. No. 09/302,048, entitled "Interchangeable Ornament Jewelry Display," filed Apr. 29, 1999.

A portion of the disclosure of this patent document contains material which is subject to copyright protection. The owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention (Technical Field)

The present invention relates to jewelry, particularly to a jewelry apparatus that permits ornamental elements of the jewelry, such as beads, to be interchangeable so that a wide variety of ornamental elements may be used in conjunction with the basic component of the jewelry.

2. Background Art

Jewelry has always been considered an important element of a well-dressed individual, reflecting the personality and taste of the wearer. Due to the often significant expense involved in acquiring jewelry pieces, however, many individuals have necessarily limited their own collection to a few pieces. Such pieces may become outdated, or no longer coordinate with the wearer's wardrobe.

Another area that allows a person to express their individuality is the avocation of bead collecting. The increasing popularity of this field has led to the desire for novel ways to display beads. Jewelry is perfectly suited for display of beads, as the particular piece can often enhance the appearance of the selected bead. Interchangeability in such items of jewelry is very desirable in order to allow the wearer to change the particular bead or beads displayed, to color-coordinate or contrast with the wearer's garments, or to compliment the occasion, and the like.

Others in the past developed various jewelry pieces that allow for more than one displayed ornament or gem. For example, U.S. Pat. No. 5,669,241, to Kohl, entitled Hinged Finger Ring; U.S. Pat. No. 5,428,974, to Shinohara, entitled Ornament; U.S. Pat. No. 5,353,608, to Berkowitz, entitled Multi-Use Jewelry Piece; U.S. Pat. No. 4,726,200, to Carter, entitled Combination Ring Pendant; U.S. Pat. No. 1,792,534, to Germain, entitled Article of Jewelry; and U.S. Pat. Nos. 2,585,183 and 1,553,198, both to Stern and entitled Jewelry, all disclose a fixed pair or multiple gems or stones that can be interchangeably displayed, either via a hinged set of rings/pendants or a pivotal/reversible setting.

Other patents disclosed various items of jewelry with interchangeable gems or stones. These include the following: U.S. Pat. No. 5,228,317, to Hendricks, entitled Gem Changer Ring; U.S. Pat. No. 4,080,803, to Suzuki, entitled Jewelry Article with Selectively Visible Portions; U.S. Pat. No. 792,334, to Levy, entitled Finger Ring; U.S. Pat. No. 922,212, to Tropin, entitled Jewelry; U.S. Pat. No. 685,044, to Haussmann, entitled Jewelry; U.S. Pat. No. 4,977,757, to Mesica, entitled Jewelry with Rotatable Ornamentation; U.S. Pat. No. 4,879,882, to Johnson, entitled Jewelry with Interchangeable Elements; U.S. Pat. No. 5,836,176, to Lichtenstein, entitled Earring Assembly with Removable Ornaments; U.S. Pat. No. 4,430,869, to Zinni, entitled Pendant Frame with Retained Elements; U.S. Pat. No. 4,353,225, to Rogers, entitled Jewelry for Animals; U.S. Pat. No. 4,259,850, to Lalieu, entitled Earring with Selectable Decorative Element; and U.S. Pat. No. 1,710,734, to Johnson, entitled Pendant.

The prior art delineated above shares the common feature of lack of a stable and secure closure mechanism. The need for a mechanism that allows easy interchangeability, and yet guards against accidental loss of the interchangeable elements, but resists breakage due to forcing or overuse, prompted the development of the present invention.

The present invention is an apparatus for displaying the ornamental portion of jewelry, such as colored beads (whether artificial or of naturally occurring stone).

The invention successfully addresses the problems encountered with the wear and tear that results from repeatedly changing the ornament, through the use of a novel twisting and sliding catch mechanism. The construction of the present invention results in jewelry pieces that allow interchangeability of displayed ornamental elements, such as beads, in an attractive setting, while decreasing the risk of breakage of the holder and subsequent loss of the displayed ornament.

SUMMARY OF THE INVENTION (DISCLOSURE OF THE INVENTION

Broadly described, the inventive jewelry apparatus of the invention may function as practically any type of jewelry, but is well-suited to serve as a pendant or broach. The principal feature of the invention is that it permits the user to selectively change the jewelry's appearance by interchanging from a variety of different ornamental elements, such as beads or charms. The principal elements of the apparatus are a base piece, which is itself decorative, a slotted locking member upon the base piece, an attractive shaft that is removably connectable to the base piece by means of the slotted locking member, a pivotal pin and pin security catch combination on the base element for attaching the apparatus to a garment if desired, and decorative elements such as colorful beads(one or more) that are placed upon the shaft, preferably by sliding the shaft through a hole or loop in the ornamental element. The locking member preferably defines a loop with respect to the base piece, so that a necklace chain optionally may be passed there through to allow the apparatus to hang from the user's neck as a pendant.

Accordingly, the invention permits a user to change the ornamental elements by removing the shaft from the base piece and selectively interchanging the ornamental elements and then replacing the shaft upon the base piece. Alternatively, the entire shaft with ornamental elements thereon may be selectively replaced. In either case, a single base piece is used, allowing the user to change the overall appearance of the jewelry apparatus to customize it to occasion or apparel. Two security features are provided to assure that the shaft cannot accidentally be removed from the base piece to result in the loss of the ornamental elements. The first feature is a curved or undulating shape given to the slotted locking member, which discourages the shaft from accidentally sliding up and out of the slot in the locking member while the apparatus is in use. Secondly, the pin is closed while the apparatus is in use, placing the pin transverse across the locking member in a position which bars the shaft from sliding in the locking member to a point where it might accidentally be released from the base piece.

Thus, there is provided according to the invention an interchangeable ornament jewelry display apparatus comprising a base piece, the base piece having a locking member defining a slot therein, the slot having a narrow segment and a wide segment; a shaft having a proximal end and a distal end; a small knob on the proximal end, comprising a dimension less than the width of the wide segment of the slot and greater than the width of the narrow segment of the slot, and at least one ornamental element disposable upon the shaft; wherein the small knob is insertable through the broad segment and the shaft is slidable from the broad segment of the slot into the narrow segment to engage the small knob with the narrow segment, thereby to removably attach the shaft to the locking member.

The apparatus preferably further includes a pin pivotally disposed upon the base and pivotable between an open position remote from the locking member and a closed position proximate to the locking member and transverse to the narrow segment of the slot, and means for temporarily securing the pin in the closed position. When the pin is in the closed position, the pin prevents the shaft from sliding in the slot from the narrow segment to the broad segment, thereby prohibiting the small knob from attaining the broad segment. The slot preferably is generally vertical, and the broad segment is above the narrow segment, but the slot alternatively may be horizontal.

The one or more ornamental elements may be permanently disposed upon the shaft, in which case the customization of the apparatus for a particular use is accomplished by exchanging one shaft for another bearing different ornamental elements. Preferably, the ornamental element is removably disposed upon the shaft, so that a single shaft can be re-used with a wide variety of different ornamental elements. The ornamental element may be at least one bead having a hole defined there through, wherein the shaft is disposable through the hole to allow the bead to slide upon the shaft. In such a preferred embodiment, there is a large knob on the distal end of the shaft, the knob having a dimension greater than the radial dimension of the hole in the bead, thereby preventing the at least one bead from sliding past the distal end of the shaft.

Preferably, the locking member has two ends secured to the base piece and a medial portion spaced apart from the base piece, thereby defining a loop through which a chain may be passed to allow service of the apparatus as a pendant.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODES FOR CARRYING OUT THE INVENTION)

Figure 1:
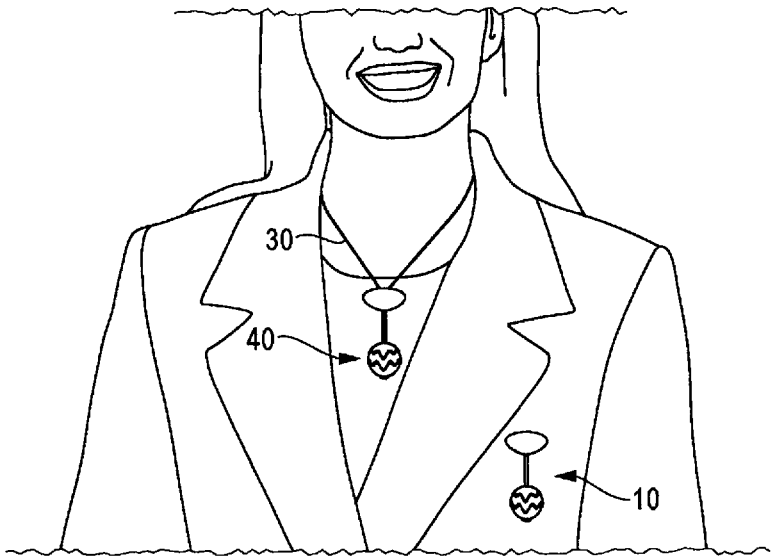
FIG. 1 is a view of the apparatus in use upon a wearer, as a pendant and as a broach.

The invention relates to jewelry for both men and women. A central advantage of the invention is the permission of ornamental interchangeability, that is, the ability to change certain ornamental elements of the jewelry. By interchanging ornamental elements of the jewelry, the user can adapt his or her jewelry to the occasion of use, or to the user's clothing color or style, and the like. Also, the interchangeability of the ornamental element allows the user to vary the appearance of her jewelry more affordably, by re-using a jewelry base piece but varying certain removable and replaceable ornamental portions. The invention finds practical use in the embodiments of pins, broaches and pendants, but is not so limited. Alternative embodiments may be used on bolo tie clasps or other items of jewelry. For example, FIG. 1 of the drawings shows a pin or broach embodiment of the interchangeable ornament jewelry display apparatus 10 and also a pendant embodiment of the interchangeable ornament jewelry display apparatus 40, both in use upon a wearer.

FIGS. 2–8 depict a preferred embodiment of the invention, one that is well-suited for use as a pin or broach, but which may also be used as a pendant upon a chain or necklace. When used as a broach the invention is used as jewelry apparatus 10 in FIG. 1; when used in combination with a chain 30 or other cord, the apparatus is the pendant jewelry apparatus 40 seen in FIG. 1. However, FIGS. 2–8 serve to describe the apparatus as used in either manner.

Figure 6:
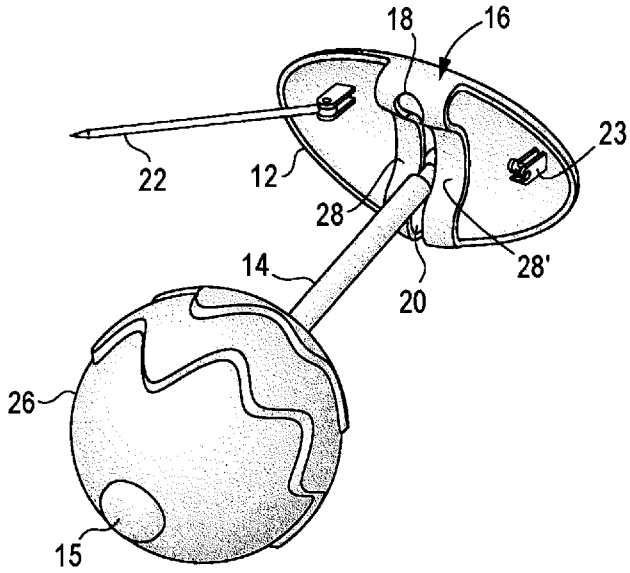
Figure 7:
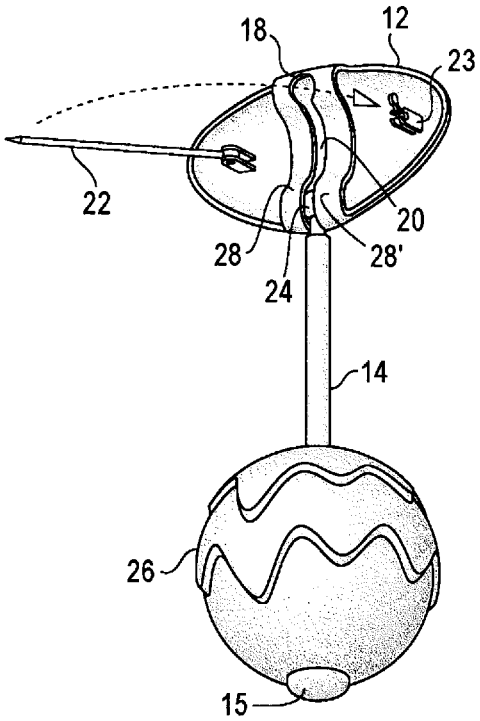
FIG. 7 is a perspective rear view of the apparatus in position for use, the dashed-line directional arrow depicting how the pin is pivoted into the closed position, as to pin the apparatus to a user's garment, and with the shaft fully engaged into the locking member and hanging down from the base piece.
Figure 8:
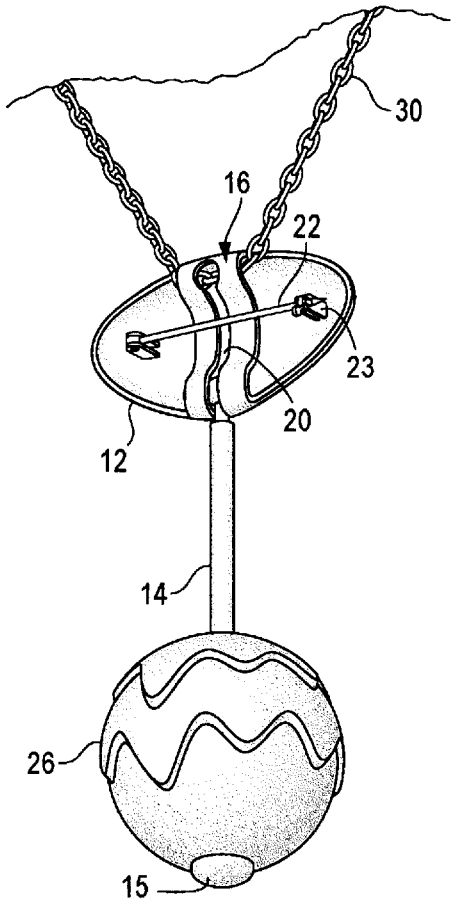
FIG. 8 is a perspective rear view of the apparatus in the use position, with a necklace chain passed behind the locking member to allow the apparatus to serve as a pendant.

Collective reference is made to FIGS. 2–8. As suggested by FIGS. 2A and 7, the jewelry apparatus may function as a broach (i.e. as seen at 10 in FIG. 1) by the use of a conventional pivotal pin 22 and pin clasp 23 known in the art, whereby the jewelry apparatus may be pinned to the wearer's garment. Alternatively, as indicated in FIGS. 2B and 8, the invention may function as a pendant suspended upon a chain 30. In this disclosure and in the claims, the term "chain" is used to indicate a typical jewelry chain, but it is immediately understood that "chain" includes all types of cords or filaments that might be used to suspend a pendant around one's neck.

As seen in the figures, the ornament jewelry display apparatus has a base piece 12. The base piece serves as the anchor or foundation of the overall apparatus, but it is to be understood that the base piece is itself crafted to be ornamental and attractive. The base piece 12 thus may be made of alloys of base or precious metal, and may be polished, or bear a an attractive engraved, embossed, or inlaid design, or gemstones, or the like. The base piece 12 is shown as having a somewhat flattened oval shape, but this is by way of example, not limitation. In practice of the invention, the base piece 12 may be fashioned to have almost any shape.

Integrated with or disposed upon the base piece 12 is a locking member 16 defining a slot 20 therein, the slot having a narrow segment between two legs 28, 28' (FIG. 5) and a broad segment 18. The drawings illustrated that in the preferred embodiment, the narrow segment of the slot depends downward from the broad segment 18, the broad segment preferably but not necessarily being a round hole. Preferably, the two legs 28, 28' of the locking member 16 which define the long narrow segment of the slot 20 are about parallel, so that the narrow segment is of substantially uniform width along its vertical length. It should be understood, however, that in certain alternative embodiments of the invention, the slot 20 may not be vertical, and indeed may be generally horizontal, with the broad segment 18 at one side end thereof. The average dimension or width of the broad segment 18 or hole is somewhat larger than the width of the long narrow segment, so that certain items may be small enough to pass through the broad segment 18 and yet be two large or wide to pass through the narrow segment of the slot 20. The overall slot 20 thus has a shape suggestive of a keyhole.

The apparatus also includes a shaft 14 having a proximal end that is attachable to the base piece 12 in a manner to be described. When the shaft 14 is attached to the base piece 12, the distal end thereof extends freely into space. Like the base piece 12, the shaft 14 may be made from precious or base metal alloys and be ornamental in its own right.

To provide for the removable attachment of the shaft 14 to the base piece 12, the proximal end of the shaft 14 is provided with a small knob 24. The small knob 24 is integrated to the shaft 14 by a narrow neck or isthmus. The small knob 24 preferably is about spherical, and has a dimension or diameter that is greater than the width of the long narrow segment of the slot 20, but which is less than the width of the broad segment 18. The shaft itself has a diameter greater than the width of the long narrow segment of the slot 20; however, the narrow neck between the small knob 24 and the body of the shaft is sufficiently narrow to fit in the narrow segment of the slot 20. Accordingly, the small knob 24 is insertable through the broad segment 18 of the slot, and the shaft 24 is slidable from the broad segment 18 into the narrow segment to engage the small knob with the narrow segment. In such a circumstance, the small knob 24 is on the other side of the legs 28, 28' from the body of the shaft 14, and since the dimension of the small knob is greater than the width of the narrow segment, the knob cannot pass between the legs 28, 28'. (The shaft's narrow neck or isthmus extends between the legs 28, 28' of the locking member 16.) With the small knob 24 on one side of the locking member 16 and the body of the shaft 14 on the other, the two being connected to by a narrow neck of material, the shaft is removably attached to the locking member. Of course, the shaft 14 may be removed from the base piece 12 by the mere expedient of sliding the shaft up along the narrow segment of the slot 20 until the small knob 24 obtains the relatively wider opening of the broad segment 18, whereupon the small knob 24 may be pulled through the broad segment to extract and release the shaft from the locking member 16.

The jewelry apparatus includes least one ornamental element disposable upon the shaft 14 to lend true beauty and originality. The ornamental element may be permanently affixed to the shaft 14, but preferably is removably disposable thereon. With continued reference to FIGS. 2–8, it is seen that the ornamental element may be a bead 26. The bead 26 may have practically any shape, and may be fashioned from any material, including colorful plastic or glass, precious metal alloy, precious or semi-precious stone, or the like. Other ornamental elements besides spherical beads, or besides beads, may fulfill the object of the invention. For example, small figurines or charms of any attractive substance may be disposable upon the shaft 14. "Ornamental element" in this disclosure includes all the foregoing. In the practice of the invention, at least one ornamental element 26, but optionally more, are disposable upon the shaft 14. Preferably, the ornamental element 26 is removable from the shaft in an manner to be further described, but in alternative embodiments of the invention the advantages of the invention are nevertheless realized with the ornamental element(s) 26 permanently disposed upon the shaft 14.

Figure 3:
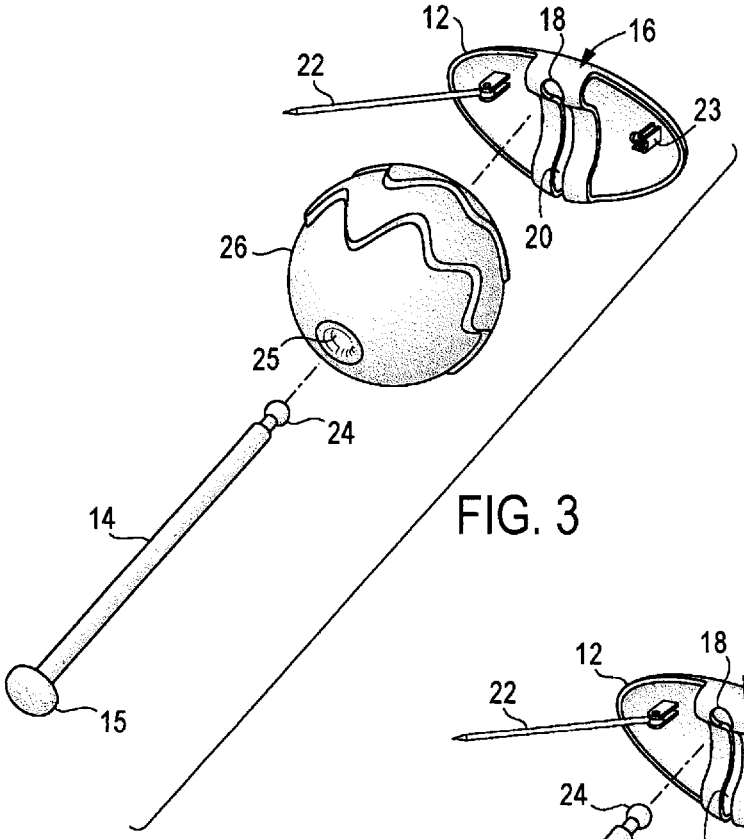
FIG. 3 is an exploded perspective view of the apparatus of the invention.
Figure 4:
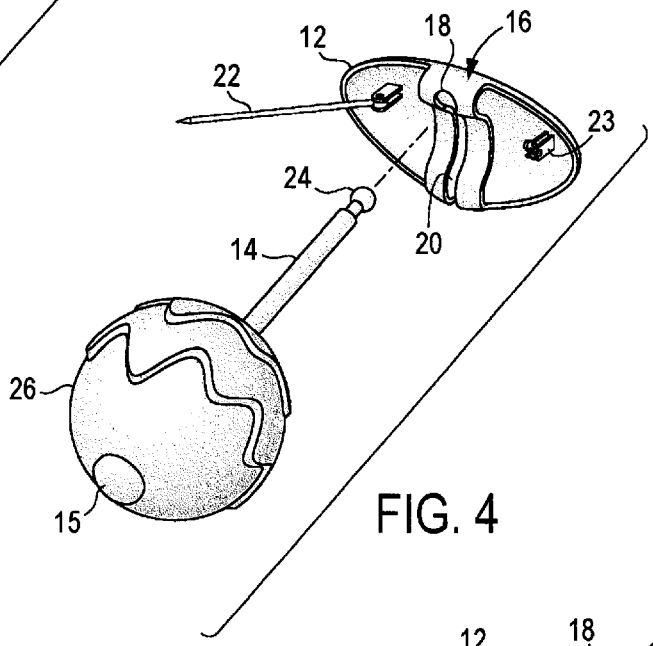
FIG. 4 is a perspective rear view of the apparatus in a position immediately prior to the insertion of the shaft element into the slotted locking member on the base piece, the shaft shown mounting an ornamental spherical bead.

Thus, in one embodiment the ornamental element 26 is removably disposed (and may even be rotatable) upon the shaft 14. The ornamental element may be one bead 26 or more having a hole 25 defined there through, so that the shaft 14 is disposable through the hole 25 to allow the bead to slide upon the shaft, as best shown by FIGS. 3 and 4. Preferably, the apparatus further features a large knob 15 on the distal end of the shaft 14, the large knob having a dimension greater than the radial dimension of the hole 25, thereby preventing the ornamental bead 26 from sliding past and off the distal end and being lost.

An added benefit of the invention is realized from the use of the pivotal pin 22. The pin 22 not only may serve as the means for attaching the jewelry apparatus to the wearer's garment (see 10 in FIG. 1), but also serves as an added security feature to prevent the shaft 14 from separating from the locking member 16. The pin 22 is pivotally disposed upon the base piece 12 and is pivotal between an open position remote from the locking member 16, as seen in FIGS. 3–7, and a closed position proximate to the locking member 16 and transverse to the narrow segment of the slot 20, as seen in FIG. 8. At a point on the base piece 12, opposite the pivotal or hinged connection of the pin 22 to the base piece, is a conventional pin clasp or catch 23 which releasably and controllably grasps the free end of the pin, thereby temporarily securing the pin in the closed position, as seen in FIG. 8. Further, and as best seen in FIG. 8, since when in the closed position the pin 22 is transverse across the narrow segment of the slot 20, the pin prevents the shaft 14 from sliding up in the slot 20 from the narrow segment to the broad segment 18, thereby prohibiting the small knob 24 from attaining the broad segment 18 from which it could be released.

The operation of the preferred embodiment is apparent from serial consideration of FIGS. 3–8. Referring to FIGS. 3 and 4, it is seen that the user may select any ornamental element 26 of choice, which may be disposed upon the shaft 14 by inserting the small knob 24 into the hole 25 of only slightly larger diameter, and sliding the ornament 26 onto the shaft 14. The ornamental element 26 is prevented from passing past and falling off the distal end of the shaft 14 by the presence of the large knob 15, which has a diameter dimension greater than the diameter of the hole 25.

Figure 5:
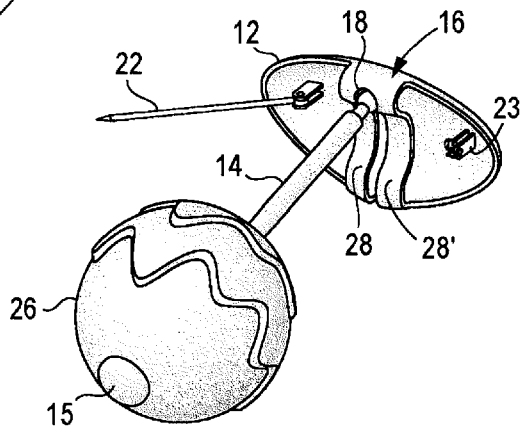
FIGS. 5 and 6 are perspective rear views similar to the view seen in FIG. 4, showing the apparatus in two stages of the process of connecting the shaft element into the locking member.

With one or more ornamental elements 26 thus disposed upon the shaft 14 and positioned as seen in FIG. 4, the shaft 14 is poised for releasable attachment to the locking member 16 on the base piece 12. As indicated in FIG. 5, this is accomplished by inserting the small knob 24 through the broad segment 18 of the slot in the locking member 16. Then, as seen in FIG. 6, the shaft 14 may slide down from the broad segment 18 into the narrow segment of the slot 20—with the narrow neck of the shaft (connecting the small knob thereto) disposed between the legs 28, 28' of locking member 16. Preferably, the shaft 14 is positioned generally horizontally while being controllably slipped along the slot 20, as seen in FIGS. 5 and 6. The sliding of the shaft 14 continues until the small knob 24 is situated at the bottom end of the narrow segment of the slot 20, at which point the shaft is secured in the locking member 16. The shaft 14 with the ornamental element 26 thereon may then be pivoted down into the final, vertical, in-use position depicted in FIG. 7.

As indicated in FIGS. 3–7, the legs 28, 28' optionally, but not necessarily, have a somewhat serpentine shape, whereby the medial or central portion of each leg is concave or is indented with respect to the top and bottom of each leg. Thus, with respect to the locations where the legs 28, 28' are affixed to the base piece 12, the central portion of the locking member 16 is depressed toward the base piece 12. This serpentine, rather than planar, configuration of the locking member 16 results in a mild undulation in the slot 20. This configuration of the locking member 16 provides added security to the in-use position of the shaft 14 as seen in FIG. 7, as the small knob 24 is barred from shifting upward by the indentation in the locking member 16. To remove the shaft 14 from the locking member 16, the shaft must be pivoted into a horizontal position, so that the user may manipulate the small knob 24 up the locking member 16, past the undulation therein. Of course, removing the shaft 14 from the locking member 16 on the base piece 12 is an advantage of the invention, since it enables the user to interchange other ornamental elements 26, or to change shafts entirely (especially in embodiments where the ornamental elements are permanently disposed upon the shaft).

With the apparatus positioned as seen in FIG. 7, the apparatus is ready to be pinned upon a garment. The pin 22 is pivoted, as suggested by the dotted directional arrow of FIG. 7, to allow it to be pushed through the garment in the ordinary manner and to bring the free end of the pin into engagement with the typical pin clasp 23 or other means for temporarily securing the pin in the closed position seen in FIG. 8. Notably, and as previously mentioned, when the pin 22 is in the closed position, it lays orthogonally or transversely across the narrow segment of the slot 20, thus barring the shaft 14 from being able to move up the slot to a position where the small knob 24 could accidentally be released through the broad segment 18. However, with the pin 22 pivoted to the open position seen in FIG. 7, the base piece 12 may be detached from the garment, and the user can deliberately free the shaft 14 from the locking member 16 by sliding the shaft up and out of the slot.

Figure 2A:
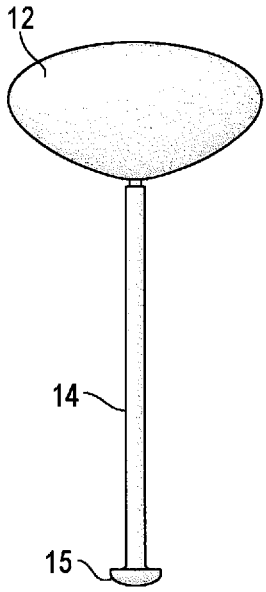
FIG. 2A is a front view of the apparatus of the invention, as it might appear when in use as a broach.
Figure 2B:
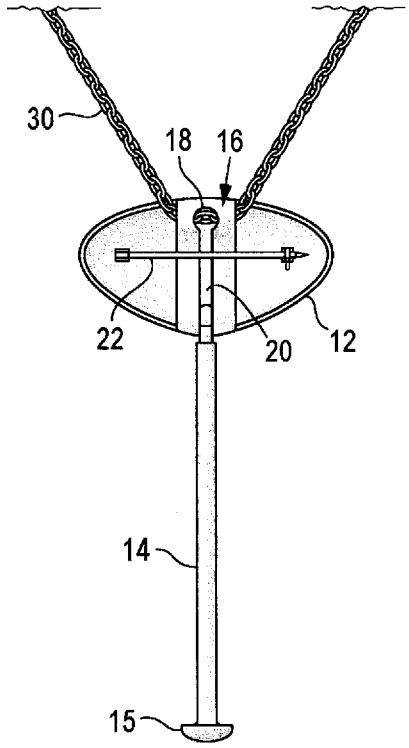
FIG. 2B is a rear view of the apparatus of the invention, as it might appear when in use as a pendant upon a chain.

Preferably, the locking member 16 has two ends (e.g. upper and lower) secured to the base piece 12 and a medial portion spaced apart from the base piece. Thus, in the preferred embodiment the locking member 16 defines a loop with respect to the base piece 12, through which a chain 30 may be passed, as seen in FIGS. 2B and 8, allowing the jewelry apparatus to serve as a pendant (40 in FIG. 1) rather than a broach. When functioning as a pendant, the pin 22 of course is temporarily secured in the closed position seen in FIGS. 2B and 8.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An interchangeable ornament jewelry display apparatus comprising:

a base piece, said base piece having a locking member defining a slot therein, said slot having a narrow segment and a vide segment;

a shaft having a proximal end and a distal end;

a small knob on said proximal end, comprising a dimension less than the width of said wide segment of said slot and greater than the width of said narrow segment of said slot, and at least one ornamental element disposable upon said shaft;

wherein said small knob is insertable through said broad segment and said shaft is slidable from said broad segment of said shaft into said narrow segment to engage said small knob with said narrow segment, thereby to removably attach said shaft to said locking member; and wherein said ornamental element is removably disposed upon said shaft and comprises at least one bead having a hole defined there through, wherein said shaft is disposable through said hole to allow said bead to slide upon said shaft.

2. An apparatus according to claim 1, further comprising:

a pin pivotally disposed upon said base and pivotable between an open position remote from said locking member and a closed position proximate to said locking member and transverse to said narrow segment of said slot; and means for temporarily securing said pin in the closed position.

3. An apparatus according to claim 2 wherein when said pin is in the closed position, said pin prevents said shaft from sliding in said slot from said narrow segment to said broad segment, thereby prohibiting said small knob from attaining said broad segment.

4. An apparatus according to claim 1 wherein said slot is generally vertical, and said broad segment is above said narrow segment.

5. An apparatus according to claim 1 wherein said ornamental element is permanently disposed upon said shaft.

6. An apparatus according to claim 1 further comprising a large knob an said distal end of said shaft, said knob having a dimension greater than the radial dimension of said hole, thereby preventing said at least one bead from sliding past said distal end.

7. An apparatus according to claim 1 wherein said locking member comprises two ends secured to said base piece and a medial portion spaced apart from said base piece, thereby defining a loop through which a chain may be passed.

8. An interchangeable ornament jewelry display apparatus comprising:

a base piece;

a locking member, said locking member defining a slot therein, said slot having a narrow segment and a wide segment, and said locking member comprising two ends secured to said base piece and a medial portion spaced apart from said base piece, thereby defining a loop through which a chain may be passed;

a shaft having a proximal end and a distal end;

a small knob on said proximal end, comprising a dimension less than the width of said wide segment of said slot and greater than the width of said narrow segment of said slot, and at least one ornamental element disposable upon said shaft;

wherein said small knob is insertable through said broad segment and said shaft is slidable from said broad segment of said slot into said narrow segment to engage said small knob with said narrow segment, thereby to removably attach said shaft to said locking member.

9. An apparatus according to claim 8 wherein said slot is generally vertical, and said broad segment is above said narrow segment.

10. An apparatus according to claim 8 wherein said ornamental element is permanently disposed upon said shaft.

11. An apparatus according to claim 8 wherein said ornamental element is removably disposed upon said shaft.

12. An apparatus according to claim 11 wherein said ornamental element comprises at least one bead having a hole defined there through, and wherein said shaft is disposable through said hole to allow said bead to slide upon said shaft.

13. An apparatus according to claim 12 further comprising a large knob an said distal end of said shaft, said knob having a dimension greater than the radial dimension of said hole, thereby preventing said at least one bead from sliding past said distal end.

14. An apparatus according to claim 13, further comprising:

a pin pivotally disposed upon said base and pivotable between an open position remote from said locking member and a closed position proximate to said locking member and transverse to said narrow segment of said slot; and means for temporarily securing said pin in the closed position.

15. An apparatus according to claim 14 wherein when said pin is in the closed position, said pin prevents said shaft from sliding in said slot from said narrow segment to said broad segment, thereby prohibiting said small knob from attaining said broad segment.

16. An interchangeable ornament jewelry display apparatus comprising:

a base piece, said base piece having a locking member defining a slot therein, said slot having a narrow segment and a wide segment;

a shaft having a proximal end and a distal end;

a small knob on said proximal end, comprising a dimension less than the width of said wide segment of said slot and greater than the width of said narrow segment of said slot, and at least one ornamental element disposable upon said shaft;

wherein said small knob is insertable through said broad segment and said shaft is slidable from said broad segment of said shaft into said narrow segment to engage said small knob with said narrow segment, thereby to removably attach said shaft to said locking member; and wherein said locking member comprises two ends secured to said base piece and a medial portion spaced apart from said base piece, thereby defining a loop through which a chain may be passed.

17. An apparatus according to claim 16 further comprising:

a pin pivotally disposed upon said base and pivotable between an open position remote from said locking member and a closed position proximate to said locking member and transverse to said narrow segment of said slot; and means for temporarily securing said pin in the closed position.

18. An apparatus according to claim 17 wherein when said pin is in the closed position, said pin prevents said shaft from sliding in said slot from said narrow segment to said broad segment, thereby prohibiting said small knob from attaining said broad segment.

19. An apparatus according to claim 16 wherein said slot is generally vertical, and said broad segment is above said narrow segment.

20. An apparatus according to claim 16 wherein said ornamental element is removably disposed upon said shaft.

* * * * *